US006658687B1

(12) United States Patent
McDonald

(10) Patent No.: US 6,658,687 B1
(45) Date of Patent: Dec. 9, 2003

(54) HAIRBRUSH WITH INTEGRAL RADIO RECEIVER

(76) Inventor: Thomas G. McDonald, 217 Morningside Dr., San Antonio, TX (US) 78209

( * ) Notice: Subject to any disclaimer, the term of this patent is extended or adjusted under 35 U.S.C. 154(b) by 0 days.

(21) Appl. No.: 09/588,874

(22) Filed: Jun. 7, 2000

(51) Int. Cl.[7] ..... A46B 15/00
(52) U.S. Cl. ..... 15/105; 455/344
(58) Field of Search ..... 15/105, 159.1; D14/168, 172; 455/344, 347, 351

(56) References Cited

U.S. PATENT DOCUMENTS

| | | | | |
|---|---|---|---|---|
| 2,688,971 | A | * | 9/1954 | Daniels et al. |
| 2,927,995 | A | | 8/1960 | Francis |
| 2,966,550 | A | | 12/1960 | Goldberg et al. |
| 2,981,963 | A | | 5/1961 | Peilet et al. |
| 3,792,486 | A | | 2/1974 | Lange et al. |
| 4,035,731 | A | | 7/1977 | Dixon |
| 4,066,967 | A | | 1/1978 | Spina |
| 4,314,137 | A | * | 2/1982 | Dorn |
| 4,419,770 | A | * | 12/1983 | Yagi et al. |
| 4,641,014 | A | | 2/1987 | Bland |
| 4,792,994 | A | | 12/1988 | Aylward |
| 4,856,364 | A | | 8/1989 | Dixon |
| 4,915,670 | A | | 4/1990 | Nesbit |
| 4,971,320 | A | | 11/1990 | Nesbit et al. |
| 5,029,239 | A | | 7/1991 | Nesbit |
| D319,059 | S | | 8/1991 | Divine |
| 5,165,131 | A | * | 11/1992 | Staar |
| D347,319 | S | | 5/1994 | Friedman |
| D363,164 | S | | 10/1995 | West |
| 5,485,646 | A | * | 1/1996 | Merritt |
| 5,595,437 | A | | 1/1997 | Rapisarda et al. |
| 5,924,159 | A | | 7/1999 | Haitin |

* cited by examiner

*Primary Examiner*—Terrence R. Till
(74) *Attorney, Agent, or Firm*—Wayne J. Colton, Inc.

(57) ABSTRACT

A radio hairbrush generally comprises a body, having a plurality of bristles dependently secured thereto; a handle; a radio receiver integral with the body; and an audio output device. The radio receiver is contained within a cavity internal to the body and all controls for the radio receiver are sealed to prevent the ingress of fluids to the cavity. The controls may include an ON-OFF control for the radio receiver and a volume control for controlling the level of sound generated by the audio output device. A plurality of orifices through the body are positioned adjacent to the audio output device for allowing the emanation through the body of sound waves emitted from the audio output device. A flexible membrane, such as a thin, plastic sheet, is interposed between the audio output device and the orifices to prevent the ingress of fluids through the orifices to the cavity. The handle comprises a compartment adapted to retain a power source, such as one or more batteries, for the radio receiver and a removable cap, for allowing access to the compartment for placement and/or removal of the battery or batteries. The cap is adapted to form a watertight seal to the compartment by the placement of a gasket, O-ring or other like structure adjacent to or within the cap.

20 Claims, 1 Drawing Sheet

HAIRBRUSH WITH INTEGRAL RADIO RECEIVER

FIELD OF THE INVENTION

The present invention relates to brushes. More particularly, the invention relates to a hairbrush having housed therein a radio receiver for providing audio entertainment during the hair brushing task.

BACKGROUND OF THE INVENTION

In the past, sound generators or radio receivers have been incorporated into a vast array of devices for personal entertainment or even to encourage proper habits through reward. Although proper maintenance of the hair is important for general hygiene, however, there has been very little development toward the incorporation of audio devices into hairbrushes or the like. Because the task of hair brushing often involves water and/or other hair care products, the incorporation of electrical devices has previously been limited to simple devices that are easily sealed within a brush structure. For example, U.S. Pat. No. 5,924,159 issued Jul. 20, 1999 to Haitin ("Haitin") discloses a brush having a sound generator that rewards brushing movements of a certain speed, force and duration. Haitin, which is limited to very simple output, however, does not extend to the incorporation of more sophisticated entertainment providing structures. Likewise, U.S. Pat. No. 4,641,014 issued Feb. 3, 1987 to Bland ("Bland") discloses a hand held hair dryer with a housed radio receiver. The dryer of Bland, however, does not contact wet hair or flowing water and thus does not include those features necessary to the incorporation of a radio receiver within a hairbrush.

It is therefore a specific object of the present invention to incorporate a radio receiver into a conventional hairbrush, whereby the user may have the benefits of audio entertainment to relieve the tedium of hair brushing notwithstanding the generally incompatible environment presented by the task. It is a further object of the present invention to provide such a hairbrush in a compact and convenient form that is also economical to produce.

SUMMARY OF THE INVENTION

In accordance with the foregoing objects, the present invention—a radio hairbrush—generally comprises a body, having a plurality of bristles dependently secured thereto; a handle; a radio receiver integral with the body; and an audio output device. The radio receiver is contained within a cavity internal to the body and all controls for the radio receiver are sealed to prevent the ingress of fluids to the cavity. Preferably, the controls include at least an ON-OFF control for the radio receiver and a volume control for controlling the level of sound generated by the audio output device.

In at least one embodiment of the present invention, a plurality of orifices through the body are positioned adjacent to the audio output device for allowing the emanation through the body of sound waves emitted from the audio output device. In this embodiment, a flexible membrane, such as a thin, plastic sheet, is interposed between the audio output device and the orifices to prevent the ingress of fluids through the orifices to the cavity.

The handle preferably comprises a compartment adapted to retain a power source, such as one or more batteries, for the radio receiver. The handle further comprises a removable cap, for allowing access to the compartment for placement and/or removal of the battery or batteries, which is adapted to form a watertight seal to the compartment. In at least one embodiment, this seal may be achieved by placement of a gasket, O-ring or other like structure adjacent to or within the cap.

Finally, many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

DETAILED DESCRIPTION OF THE PREFERRED EMBODIMENT

Figure 1:
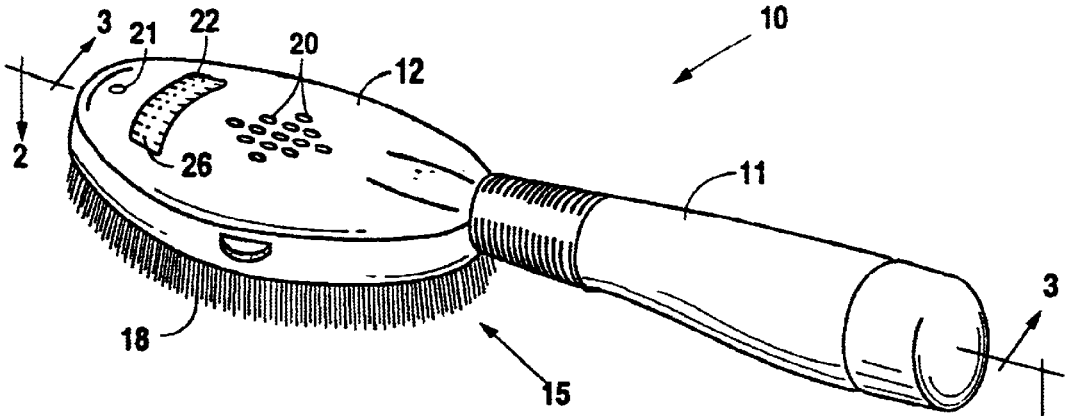
FIG. 1 shows, in a perspective view, the preferred embodiment of the present invention—a hairbrush with integral radio receiver.

Although those of ordinary skill in the art will readily recognize many alternative embodiments, especially in light of the illustrations provided herein, this detailed description is exemplary of the preferred embodiment of the present invention, the scope of which is limited only by the claims appended hereto.

Referring now to the Figures, the preferred embodiment of the present invention—a hairbrush 15 with integral radio receiver 10, generally comprises a handle 11, a body 12, a radio receiver 13 and an audio output device 14, such as for example, a speaker. According to the preferred embodiment, the handle 11 is integrally formed with, or otherwise secured to, the body 12 of the hairbrush 15. The body 12 of the hairbrush 15, as will be better understood further herein, fully encloses the radio receiver 13 and audio output device 14. In this manner, the electrical components 16 of the present invention may be protected from water and/or hair care products. Additionally, the batteries 17 for operation of the radio receiver 13 are preferably conveniently housed within the handle 11. As a result, the hairbrush 15 is adapted to provide a compact and convenient entertainment source, particularly suited to relief of the brushing tedium. It is expected that this combination will, especially among younger users, greatly encourage more thorough and frequent brushing by the addition of a fun element to an otherwise time-consuming and laborious chore.

Referring now specifically to FIG. 1, the body 12 of the hairbrush 15 is shown to generally comprise a plurality of bristles 18 dependently secured adjacent one side of a substantially fluid impermeable body 12. According to the preferred embodiment of the present invention, the body 12 is constructed of a plastic or like material, which is lightweight and inexpensive to manufacture yet generally fluid impervious. While those of ordinary skill in the art will recognize many possible substantial equivalents, it is only critical that such substitutions provide a water resistant housing for the radio receiver 13 and audio output device 14.

As a result, all such substitutions should be considered within the scope of the present invention, which is limited only by the claims appended hereto. Likewise, the bristles 18 may comprise any of a number of materials such as, for example, wire or plastic, although they should in any case be constructed and operative as are those of an ordinary hairbrush. Because it is preferred that the cavity 19 internal the body 12 be fluid impermeable, however, in order to protect the various components 16 of the radio receiver 13 from damage, the bristles 18 should be secured to the body 12 in a manner that precludes the infusion of fluids through their points of affixation. This may be accomplished, for example, by securing the bristles 18 into indentations in said body 12 that do not fully penetrate the body 12 or, in the alternative, by filling orifices of affixation with an epoxy resin or the like.

Figure 3:
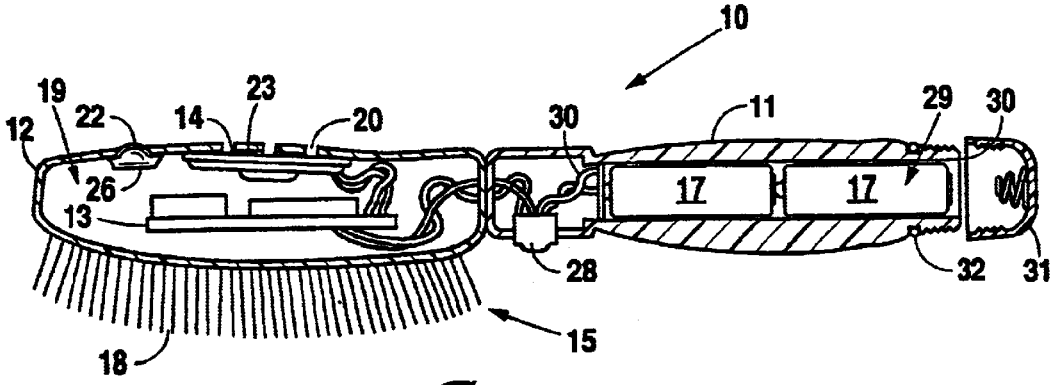
FIG. 3 shows, in a side cross-sectional view, the hairbrush of FIG. 1.

As also shown in FIGS. 1 and 3, the body 12 of the hairbrush 15 further comprises a plurality of orifices 20 for the transmission therethrough of sound waves, a power indicator 21 and a window 22 for indication of the selected radio station. To prevent the ingress of water and other fluids, thereby maintaining the integrity of the radio receiver 13, a fluid impermeable membrane 23 is preferably interposed between the sound orifices 20 and the radio receiver 13. Such a membrane 23 may comprise, for example, a thin sheet of plastics material circumferentially adhered to the internal surface of the body 12 about the extent of the sound orifices 20. The power indicator 21, which may comprise a light-emitting diode ("LED") or the like, is also preferably placed in sealed engagement with the body 12 of the hairbrush 15. Such sealed engagement may be achieved, for example, by placing an epoxy resin around the glass or plastic circumference of the indicator 21 and in sealing contact with the circumferential extent of the orifice therefor. In the alternative, the indicator 21 may be positioned within the cavity 19 in the area of a translucent window integral with and through the body 12. In this manner, a power on condition may be indicated to the user, thereby preventing inadvertent battery drainage without compromise to the fluid resistant integrity of the present invention. Finally, a tuning window 22 is similarly provided in the body 12 of the hairbrush 15 so that the user may readily tune the receiver 13 to a desired station.

Figure 2:
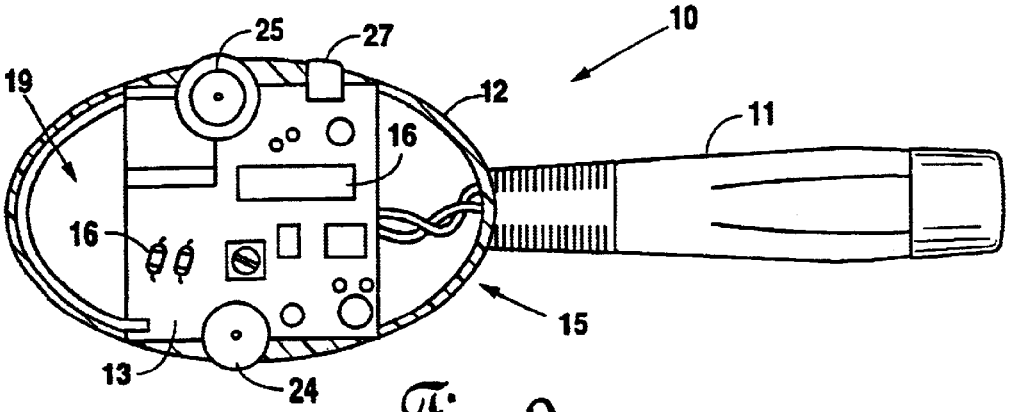
FIG. 2 shows, in a top cross-sectional view, the audio receiver internal the hairbrush of FIG. 1.

Referring now to FIG. 2 particularly, the radio receiver 13 of the hairbrush 15 is further detailed. According to the preferred embodiment of the present invention, the radio receiver 13, which may comprise a standard AM-FM receiver modified in accordance with teachings herein, is securely mounted within the body's internal cavity 19. An integral ON-OFF-VOLUME control 24, a tuning control 25, a tuning scale 26 and an AM-FM control 27, as are well known to those of ordinary skill in the electrical arts, are provided. Although those of ordinary skill will recognize that separate power and volume controls may be provided, it is preferred that an integral control 24 be utilized in this application to minimize the opportunity for fluid ingress. In the preferred embodiment of the present invention, each exteriorially extending control 24, 25, 27 of the radio receiver 13 are selected to be fluid resistant while the antenna for the radio receiver is implemented in a low profile form for mounting entirely within the cavity 19. Each of these components 24, 25, 27 are readily available to those of ordinary skill in the art. For example, many manufacturers produce button-type single or double pole, single or double throw switches in weatherproof and/or water tight designs. Exemplary of these manufacturers are Clarostat of El Paso, Tex.; Honeywell of Freeport, Ill.; and NKK Switches of Scottsdale, Ariz. In the alternative, other manufacturers, such as APM Hexseal of Mesa, Ariz., produce rubber boots and seals in many standard or custom forms for weatherproofing standard, off-the-shelf switches and rotary selectors.

Referring now to FIG. 3, the handle 11 of the radio hairbrush is shown to comprise a mute switch 28, for convenient audio disruption and a battery compartment 29. The mute switch 28 may be used to temporarily interrupt the receiver's audio output, for brief conversation or the like, without interrupting the brushing task. According to the preferred embodiment of the present invention the handle 11 of the hairbrush 15 is also constructed of a plastic or like material for protection of the batteries 17 and electrical components internal thereto. As also shown in the Figure, electrical wiring 30 connects the radio receiver 13 to the power source, which may typically comprise two standard 1.5 V alkaline or rechargeable batteries 17 connected in series retained within a battery compartment 29 by a cap 31. The cap 31 is preferably sealed with an O-ring 32 or the like, which may comprise a rubber, polymeric or other similar material, to prevent the ingress through the battery compartment 29 of water or other fluids.

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and claims drawn thereto. For example, those of ordinary skill in the art will recognize that the radio receiver 13 may be replaced with a miniature compact disc player, cassette player, MP-3 player or the like. In the case of the MP-3 player, or other digital storage medium, the audio download may be through a translucent window utilizing an infrared interface or the like. Likewise, the handle 11 of the hairbrush 15 may be provided with an externally projecting charging plug, thereby allowing the permanent sealing of the batteries 17 within the handle 11 to further ensure that fluids do not ingress to the cavity 19 of body 12. The only critical aspect for each of the foregoing examples, however, is that care be taken to protect the internal electrical components from fluids and other hair care products. In any case, because the scope of the present invention is much broader than any particular embodiment, the foregoing detailed description should not be construed as a limitation of the scope of the present invention, which is limited only by the claims appended hereto.

What is claimed is:

1. A radio hairbrush for providing entertainment during the hair brushing task, said radio hairbrush comprising:

a hairbrush having a body and a handle, said body having a plurality of bristles dependently secured to a first side thereof;

a radio receiver integral with said body; and an audio output device integral with said body.

2. The radio hairbrush as recited in claim 1, wherein said radio receiver is contained within a cavity internal to said body.

3. A radio hairbrush for providing entertainment during the hair brushing task, said radio hairbrush comprising:

a hairbrush having a body and a handle, said body having a plurality of bristles dependently secured to a first side thereof;

a radio receiver contained within a cavity internal to said body;

an audio output device; and wherein said radio receiver comprises a plurality of functional controls.

4. The radio hairbrush as recited in claim 3, wherein said functional controls include an ON-OFF control for said radio receiver.

5. The radio hairbrush as recited in claim 4, wherein said functional controls further include a volume control, said volume control being adapted to control the level of sound generated by said audio output device.

6. The radio hairbrush as recited in claim 5, wherein said volume control is integrated with said ON-OFF control.

7. The radio hairbrush as recited in claim 3, wherein said functional controls are adapted to prevent the ingress of fluids to said cavity.

8. The radio hairbrush as recited in claim 7, wherein said functional controls comprise at least one watertight switch.

9. The radio hairbrush as recited in claim 7, wherein said functional controls comprises at least one protective boot.

10. The radio hairbrush as recited in claim 3, wherein said audio output device is dependently secured within said cavity.

11. The radio hairbrush as recited in claim 10, wherein said audio output device is secured to an internal portion of a second side of said body, said second side being opposite said first side.

12. The radio hairbrush as recited in claim 11, wherein said second side of said body comprises a plurality of orifices, said orifices being positioned adjacent said audio output device for allowing the emanation through said body of sound waves emitted from said audio output device.

13. The radio hairbrush as recited in claim 12, wherein a flexible membrane is interposed between said audio output device and said orifices.

14. The radio hairbrush as recited in claim 13, wherein said flexible membrane is adapted to prevent the ingress of fluids through said orifices to said cavity.

15. The radio hairbrush as recited in claim 14, wherein said flexible membrane comprises a plastic sheet.

16. The radio hairbrush as recited in claim 3, wherein said handle comprises a compartment adapted to retain a power source for said radio receiver.

17. The radio hairbrush as recited in claim 16, wherein said power source comprises a battery.

18. The radio hairbrush as recited in claim 17, wherein said handle further comprises a removable cap for allowing access to said compartment for placement of the battery.

19. The radio hairbrush as recited in claim 18, wherein said cap is adapted to form a watertight seal to said compartment.

20. The radio hairbrush as recited in claim 19, wherein said handle comprises a polymeric gasket adapted to form said seal.

* * * * *